US006155556A

United States Patent [19]

Lynch et al.

[11] Patent Number: 6,155,556

[45] Date of Patent: Dec. 5, 2000

[54] DOCUMENT FEEDING APPARATUS

[75] Inventors: Andrew Lynch, Dundee; Robert J. Suttie, Alyth; George Petrie, Dundee, all of United Kingdom

[73] Assignee: NCR Corporation, Dayton, Ohio

[21] Appl. No.: 09/114,088

[22] Filed: Jul. 10, 1998

[30] Foreign Application Priority Data

Sep. 5, 1997 [GB] United Kingdom ..... 9718798

[51] Int. Cl.[7] ..... B65H 3/06

[52] U.S. Cl. ..... 271/117; 271/145; 271/147; 271/160; 271/167; 271/122; 271/126; 271/149

[58] Field of Search ..... 271/10.06, 10.09, 271/118, 117, 122, 124, 125, 126, 149, 157, 34, 147

[56] References Cited

U.S. PATENT DOCUMENTS

| | | | |
|---|---|---|---|
| 3,635,465 | 1/1972 | Beery | 271/41 |
| 4,670,643 | 6/1987 | Hain et al. . | |
| 4,917,512 | 4/1990 | Mimura et al. | 271/263 |
| 4,919,412 | 4/1990 | Weigel et al. . | |
| 5,141,127 | 8/1992 | Graef et al. | 271/162 |
| 5,209,465 | 5/1993 | Sayama et al. | 271/110 |
| 5,295,675 | 3/1994 | Hain . | |

FOREIGN PATENT DOCUMENTS

| | | |
|---|---|---|
| 0600848 | 6/1994 | European Pat. Off. . |
| 2102390 | 2/1983 | United Kingdom . |

*Primary Examiner*—Donald P. Walsh
*Assistant Examiner*—Jonathan R Miller
*Attorney, Agent, or Firm*—Francis L. Conte

[57] ABSTRACT

Information relating to the characteristics of the documents contained in a document cassette 16 is stored in a button memory 22 on the cassette housing and is read when the cassette 16 is inserted into a document feeding apparatus. The information is processed and correlated with data stored in the memory 74 of a control unit 70 to determine the optimum settings for a mechanism 10 for picking such documents. In particular, during a pick operation, a predetermined number of pulses are supplied to a stepper motor 50, so that when the friction belt 30 is moved into engagement with the documents of the cassette 16, an optimum pressure is exerted by the belt 30 on the documents in the cassette 16. A retard roller 52 is then moved to an optimum position in relation to the belt 30. In addition, the width of a gap between a guide plate 62 and the belt 30 is adjusted by moving the retard roller and the guide plate 62 to a predetermined width, which is optimum for accommodating documents of thickness equal to those in the cassette 16. Hence, the risks of mispicking of documents, double feeding and document jams are minimized.

30 Claims, 5 Drawing Sheets

DOCUMENT FEEDING APPARATUS

BACKGROUND OF THE INVENTION

The present invention relates to a document feeding apparatus for picking documents one by one from a stack of documents, and moving the picked documents away from the stack.

Document feeding apparatus of this kind are commonly of either the vacuum pick or friction pick type. Vacuum pick systems use a suction member to separate the first document from the rest of the stack and are particularly suitable for handling documents which are non-porous, such as currency notes in an automated teller machine (ATM). Friction type pick systems are also used in ATMs and are sometimes advantageous in that they have higher feed rate capabilities than vacuum type pick systems and are of relatively simple construction. Friction pick systems commonly use a rotating pick roller or an endless belt made from a high friction material. When the pick roller or a portion of the belt engages a first document of a stack, the frictional force exerted thereon by the roller or the belt is greater than the frictional force between this document and the next document in the stack, causing the first document to be separated from the stack and moved away by the rotating roller or belt.

In many applications, document feeding apparatus are now required to handle a wide range of media. For example, in addition to currency notes, ATMs now frequently dispense other types of documents such as tickets, travelers cheques, vouchers, sheets of stamps etc. These documents are sometimes in booklet form, where multiple sheets are bound together and are dispensed as a single document by the ATM. A known ATM document feeding apparatus of the friction pick type, which is arranged to handle other types of documents in addition to currency notes, is described in EP0600848. Documents are picked from a stack by a rotating friction roller and are passed into a nip between the friction roller and a pair of rotating stripper rolls, so as to prevent two or more documents from being fed simultaneously. The documents then pass into a gap between the friction roller and a curved guide plate, which serves to guide the documents as they are moved away from the stack by the friction roller towards a further transport system. Basic information relating to the documents to be picked, including whether or not they are currency notes and whether they are new or used, is stored in machine-readable form on the document canister. This information is processed by the ATM controller and the rotational speeds of the pick roller and stripper rolls are adjusted to preset values considered optimum for handling documents of the type identified from the stored information on the document canister.

This known ATM document feeding apparatus is capable of differentiating between four different categories of documents only, i.e., between new currency notes, used currency notes, new non-currency documents and used non-currency documents. However, the characteristics of documents may vary widely within each of these categories, particularly in the case of non-currency documents, where documents may be made from different materials and may have different dimensions. Hence, the preset rotating speeds may not be optimum for all types of documents within a particular category. Moreover, reliable picking of different types of documents by a friction pick mechanism is not solely influenced by the rotating speed of the pick roller or belt, but is dependent on a number of factors. For example, as described earlier, successful friction picking is achieved when the frictional force exerted by the rotating friction roller or belt on the first document of the stack exceeds that existing between the first and adjacent documents of the stack. The frictional forces existing between the documents of the stack is dependent on the frictional properties of the material from which the documents are made and may vary from one type of document to the next. Hence, problems may arise when picking certain types of documents which exhibit relatively high or low coefficients of friction, as the frictional force exerted by the roller or belt on the stack may be insufficient to overcome that between adjacent documents of the stack, or may be of sufficient magnitude to cause the picking of multiple documents simultaneously from the stack.

SUMMARY OF THE INVENTION

It is an object of the present invention to provide a document feeding apparatus of the friction pick type which is capable of handling different types of documents, and in which the problems associated with the known apparatus referred to above are alleviated.

According to the present invention there is provided a document feeding apparatus for picking documents one by one from a stack of documents comprising rotatable pick means arranged to frictionally engage a document to be fed from the stack and to move the document into engagement with feed means which are arranged to move the document away from the stack; and means for storing data relating to the characteristics of the documents in the stack; characterized by pressure control means for controlling the pressure exerted by the pick means on the document to be fed during a pick operation, in accordance with the characteristics of the documents in the stack.

BRIEF DESCRIPTION OF THE DRAWINGS

An embodiment of the invention will now be described by way of example with reference to the accompanying drawings, in which.

DETAILED DESCRIPTION

Figure 1:
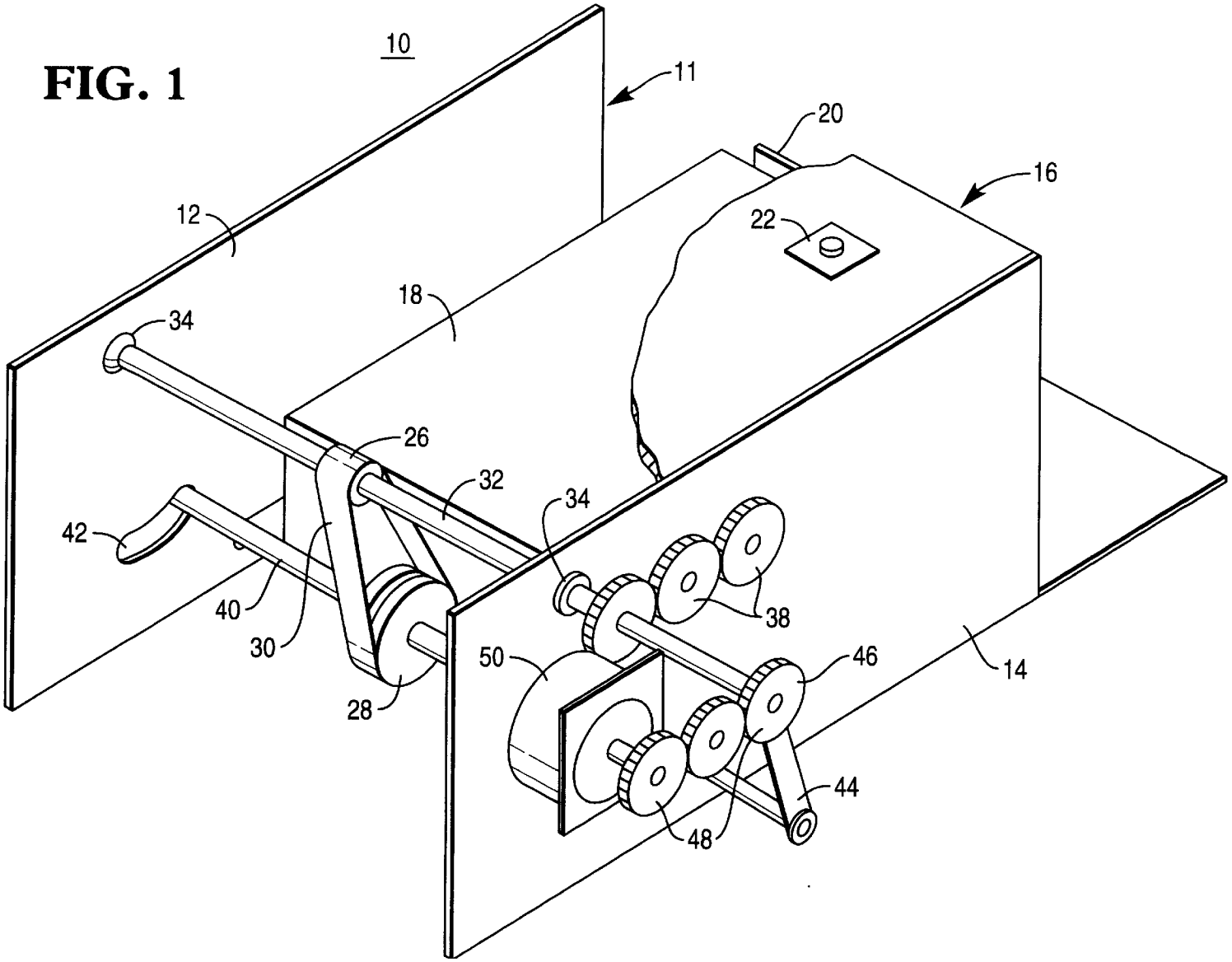
FIG. 1 is a perspective view of a document pick mechanism embodying the present invention, the mechanism serving to pick documents from an associated document cassette.
Figure 2:
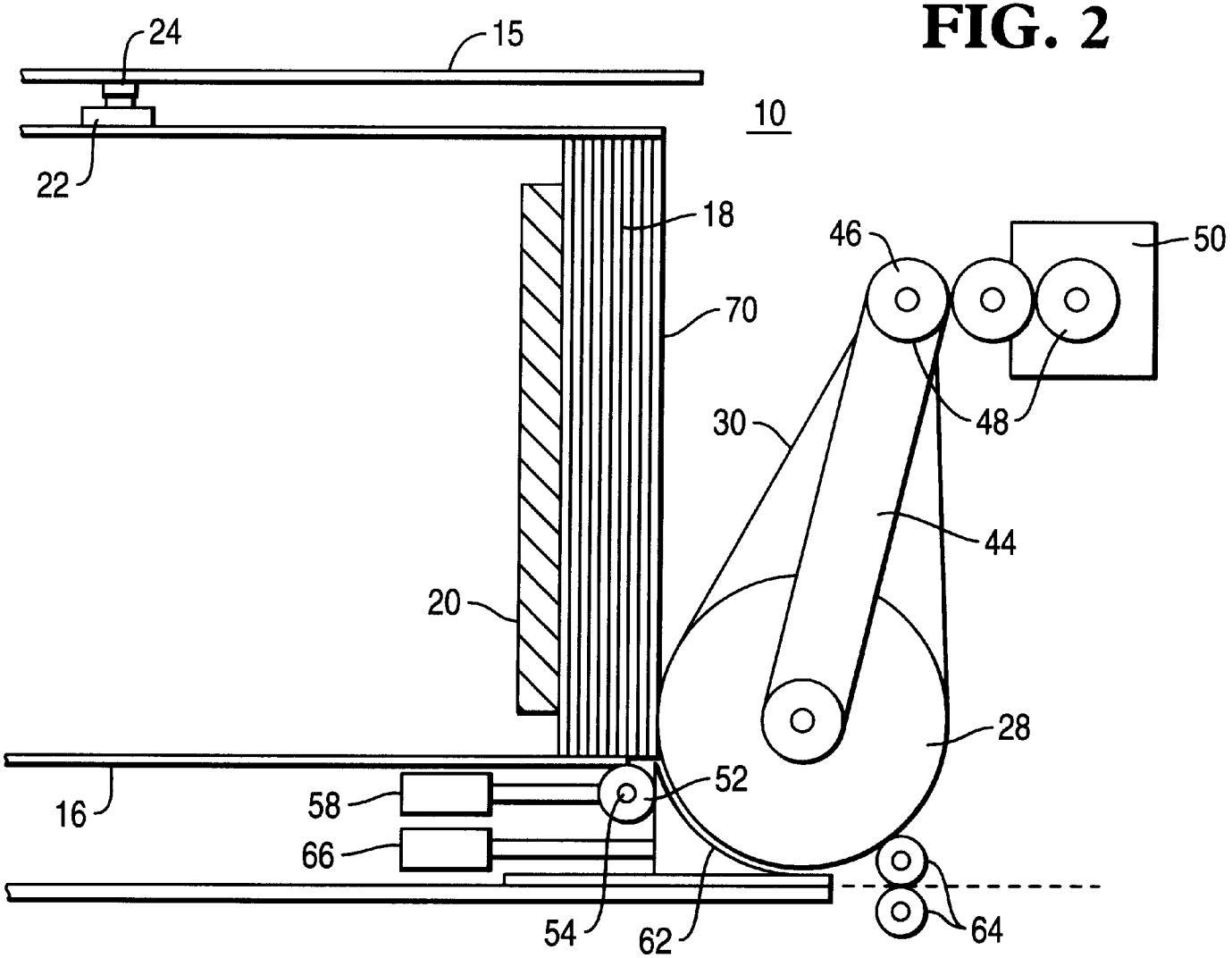
FIG. 2 is a side view of a document feeding apparatus including the pick mechanism of FIG. 1, the view being taken from the left hand side of FIG. 1 and the pick mechanism being shown in a picking position.
Figure 3:
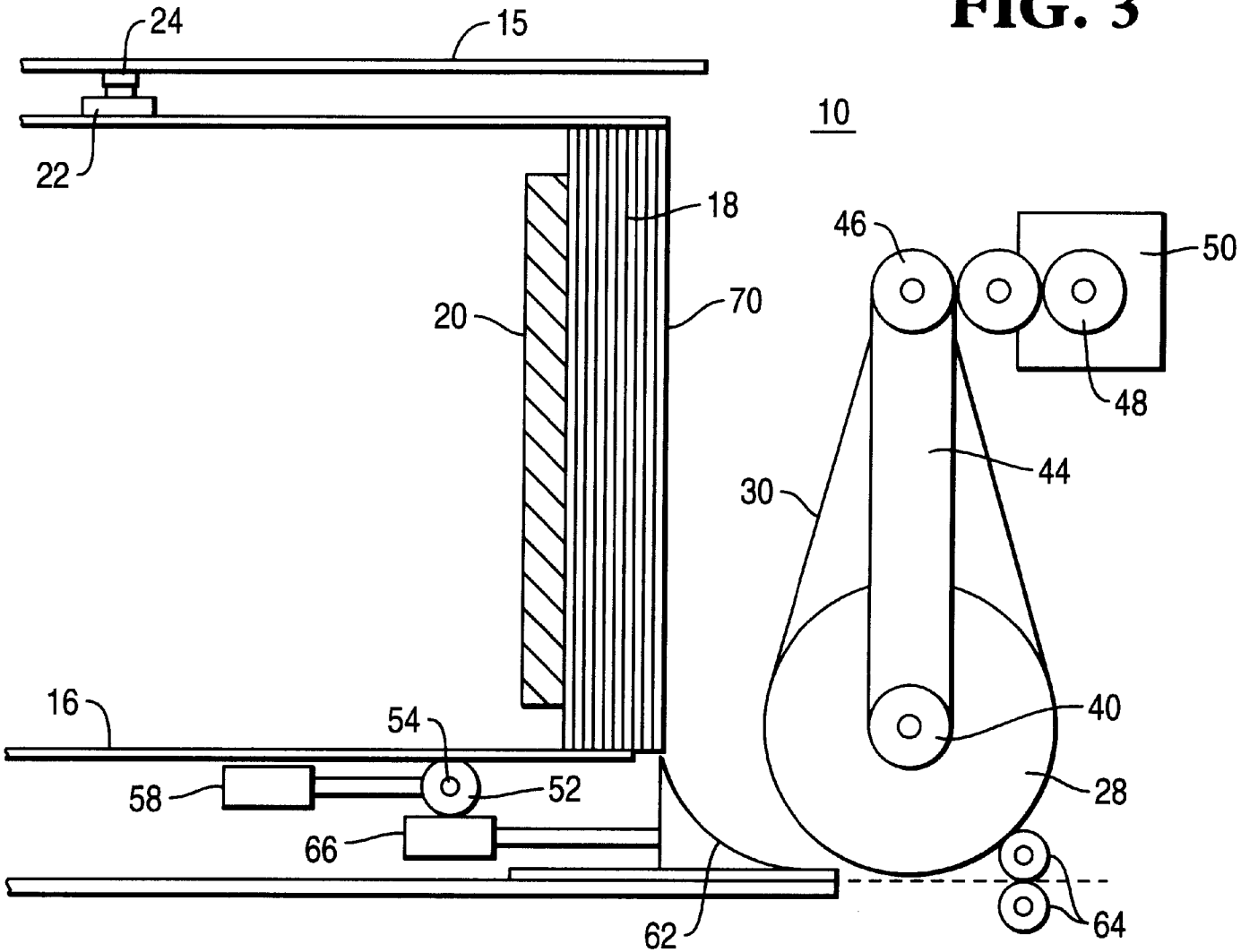
FIG. 3 is a view similar to FIG. 2 except that the pick mechanism is shown in an idle position.

Referring to FIGS. 1 to 3 of the drawings, the document feeding apparatus shown therein includes a pick mechanism 10 having a frame 11, including two vertically extending side plates 12 and 14 (not shown in FIGS. 2 and 3) mounted in parallel spaced apart relation to each other, and a horizontally extending top plate 15 (not shown in FIG. 1). The frame 11 serves to support the various drive mechanisms and other components of the document feeding apparatus, as will be described hereafter. A cassette 16 (shown partially broken away in FIG. 1) containing a stack of documents 18, such as currency notes, tickets, coupons, books of stamps or travelers cheques etc., is removably mounted in the frame 11 between the two side plates 12 and 14. The documents in the stack 18 are disposed vertically with their corresponding long edges in engagement with the base of the cassette 16. The stack of documents 18 is resiliently biased in a forward direction (from left to right with reference to FIGS. 2 and 3) by a pusher plate 20 which is urged against the rear of the stack of documents 18 by an arrangement of return springs (not shown). A button memory device 22, which stores information about the documents within the cassette 16, is provided on the upper surface of the cassette 16 and is arranged to cooperate with a button memory reader 24 (shown in FIGS. 2 and 3) which is mounted on the underside of the top plate 15 of the frame 11. The structure and operation of button type memory devices and readers are known and will not be described in detail herein.

The mechanism 10 includes a drive pulley 26 and a pick pulley 28 which support, and around which passes, an endless belt 30 of a high friction material such as a modified rubber. The drive pulley 26 is secured on a drive shaft 32 which extends between two bearing means 34, which are respectively supported by the side plates 12 and 14 of the frame 11. The drive shaft 32 of the drive pulley 26 is driven by an electric motor 36 (FIG. 5), via a gearing mechanism 38 mounted on the side plate 14 of the frame 11. The pick pulley 28 is rotatably mounted on a shaft 40 which extends through elongated arcuate slots 42 (only one of which is shown in FIG. 1) provided in the side plates 12 and 14. An arm 44 is freely mounted on one end of the drive shaft 32 and is arranged for pivotal movement about the axis thereof. The other end of arm 44 is secured to the corresponding end of the shaft 40 of the pick pulley 28 and is arranged to support the shaft 40. The arm 44 is secured to an end gear wheel 46 of a gearing mechanism 48, the end gear wheel 46 being rotatably mounted on the drive shaft 32. The gearing mechanism 48 is driven by a stepper motor 50 which is mounted on the side plate 14 of the frame 11. The other end of the shaft 40 is supported by one end of a second arm (not shown), the other end of which is freely mounted on the corresponding end of the drive shaft 32.

A retard roller 52 (not shown in FIG. 1) is provided in cooperative association with the belt 30 and the pick pulley 28, and serves to prevent the feeding of two or more documents simultaneously. The retard roller 52 has an outer annular portion of rubber having a coefficient of friction which is lower than that of the friction belt 30, and is coupled to the output shaft 54 of a motor 56 (FIG. 5), to be rotated thereby. The shaft 54 of the retard roller 52 is coupled to a first linear actuator 58 (not shown in FIG. 1), so that the position of the retard roller 52 in relation to the belt 30 can be varied by moving it toward or away from the belt 30. A first linear variable displacement transducer (LVDT) 60 (FIG. 5) is provided in cooperative association with the retard roller 52 and serves to produce signals representative of the position of the retard roller 52 in relation to the belt 30.

A guide plate 62 (not shown in FIG. 1) having a curved guide surface, extends from adjacent the nip formed between the belt 30 and the retard roller 52 and is separated from the belt 30 by a small gap. The guide plate 62 serves to guide documents which have been picked from the stack 18 towards feed rollers 64 (not shown in FIG. 1) of a transport mechanism. The guide plate 62 is coupled to a second linear actuator 66 (not shown in FIG. 1), so that it can be moved toward or away from the belt 30, thereby varying the width of the gap therebetween. A second linear variable displacement transducer (LVDT) 67 (FIG. 5) is provided in cooperative association with the guide plate 62 and serves to produce signals representative of the width of the gap between the guide plate 62 and the belt 30.

The linear actuators 58 and 66 and the linear variable displacement transducers 60 and 67 may be of any suitable type available, and since their structure and operation are well known, they will not be described in detail. For simplicity, only one pair of feed rollers 64 are shown in FIGS. 2 and 3, but it should be understood that the transport mechanism is of conventional design and typically includes a plurality of pairs of feed rollers 64 which move the documents which have been picked away from the cassette 16. A sensor 68 (FIG. 5) is positioned adjacent the first pair of feed rollers 64, and serves to detect when the leading edge of a document has been engaged by the feed rollers 64.

Figure 5:
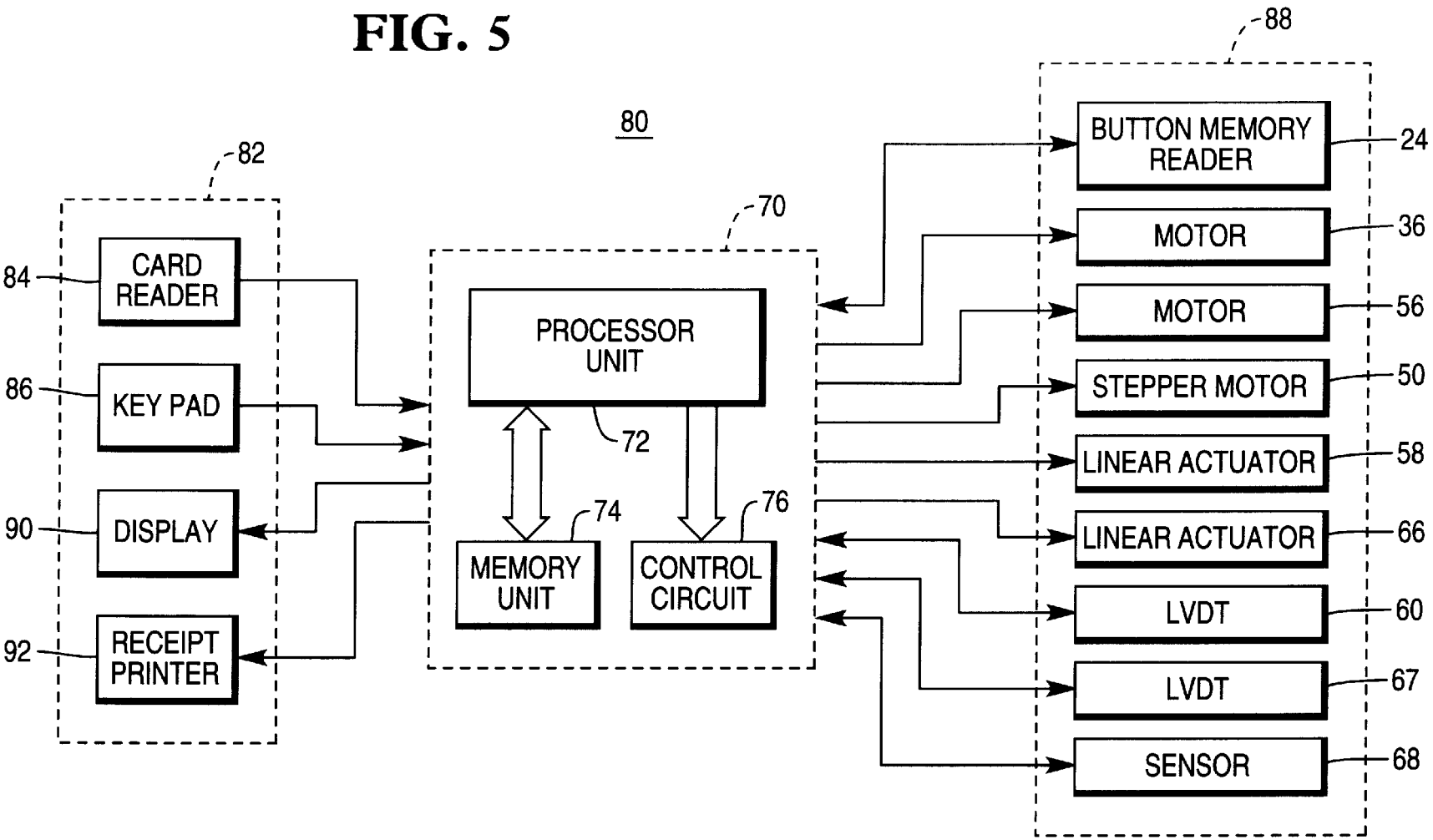
FIG. 5 is a block diagram representation of the ATM of FIG. 4.

Referring now to FIG. 5, the various mechanisms within the sheet feeding apparatus shown in FIGS. 1 to 3 are controlled by a controller unit 70, which includes a processor unit 72, a memory unit 74 and a control circuit 76. The processor unit 72 may include a microcomputer and communicates with the memory unit 74 and the control circuit 76. The processor unit 72 communicates with the button memory reader 24, the linear variable displacement transducers 60 and 67 and the sensor 68, while the control circuit 76 controls the supply of power to the button memory reader 24, the motors 36 and 56, the stepper motor 50, the linear actuators 58 and 66, the linear variable displacement transducers 60 and 67 and the sensor 68, and also provides timing control.

Also, it should be understood that, although only one belt 30 and associated pulleys 26 and 28 have been illustrated and described with reference to FIGS. 1 to 3, in practice, two or more belts 30 and associated drive 26 and pick 28 pulleys could be provided, with each drive pulley 26 being secured on the drive shaft 32, and a separate retard roller 52 assembly being cooperatively associated with each belt 30.

A replenishment operation of a document cassette 16 will now be described. The document cassette 16 is loaded with a stack of documents 18 at a replenishment station remote from the document feeding apparatus. During the replenishment operation, various data, including a cassette identification code and details relating to the documents being loaded into the cassette 16, are entered into a document management computer system at the replenishment station. A menu of the various document types which may be loaded in the cassette 16 (e.g. currency notes of various denominations, coupons, tickets, books of stamps, travelers cheques etc.) is presented to the service agent (i.e. the person responsible for replenishment of the cassettes) and the appropriate document type is selected. The agent is then requested to input the total number of documents of the selected type which are being loaded in the cassette 16. This data is processed by the document management computer system and the agent is prompted to connect the button memory 22 on the cassette 16 to a memory interface device associated with the computer system, so as to write data thereto. The data transferred to the button memory identifies the type of document and the total number of such documents contained in cassette 16, the dimensions of the documents and the material from which the documents are made. This process is repeated for each cassette 16 being replenished at the replenishment station.

A replenishment operation of the above described document feeding apparatus will now be described with reference to FIGS. 1 to 3 and FIG. 5. An empty or partially empty cassette is removed from the frame 11 of the pick mechanism 10 and is replaced by a replenished cassette 16 containing a stack of documents 18. When the cassette 16 has been fully inserted into the frame 11, the button memory 22 on the cassette housing is in alignment with the button memory reader 24 on the top plate 15 of the frame 11 and makes contact therewith. The button memory reader 24 is energized by the control circuit 76, so that data stored in the button memory 22 is read by the reader 24 and is transmitted to the processor unit 72. The processor unit 72 decodes the data read from the cassette 16 (i.e., the document type, the document dimensions and the material from which the documents are made) and correlates the decoded data with data stored in look-up tables in the memory unit 74, in order to determine the optimum settings for various parameters of the pick mechanism 10 for handling documents having such characteristics. In particular, the number of pulses to be supplied to the stepper motor 50 by the control circuit 76, so as to move the belt 30 from an idle position to a picking position as will be described later, the optimum position of the retard roller 52 when the belt 30 is in the picking position and the optimum width of the gap between the guide plate 62 and the belt 30 during a picking operation, are determined. These optimum settings are stored in the memory unit 74 to be accessed by the processor unit 72 when the next pick operation request is received for documents from cassette 16.

It should be understood that the document feeding apparatus may comprise a plurality of identical pick mechanisms 10, each of which is loaded with a separate replenished cassette 16 during a replenishment operation. Each cassette 16 may contain documents of a different type and the data relating to each cassette 16 is read, processed and stored in the memory unit 74, in the manner described above.

As will be described in more detail, by setting a predetermined number of pulses to be supplied to the stepper motor 50, the optimum pressure for picking documents of the type contained in the cassette 16 will be exerted by the friction belt 30 on the stack 18, when the belt 30 is moved into engagement therewith. For example, paper currency notes generally contain linen fibres and have a higher coefficient of friction than documents made from a glossy paper product, such as the cover of a book of stamps. Therefore, a greater pressure must be exerted by the belt 30 on such currency notes, in order to overcome the frictional forces existing between adjacent notes than would be required to overcome the frictional forces between adjacent book of stamps. By adjusting the pressure exerted by the belt 30 in accordance with the type of documents to be picked, the risk of mispicking documents is minimized.

As described above, the stack 18, however, is also resiliently biased in the forward direction (from left to right with reference to FIGS. 2 and 3) by the pressure plate 20, which is urged against the rear of the stack 18 by an arrangement of return springs. The pressure exerted on the rear of the stack 18 by the pressure plate 20 tends to oppose that exerted by the belt 30 on the front of the stack 18 during a picking operation, and is dependent on the resilience characteristics of the return springs and on the number of documents contained in the stack 18. The pressure plate 20 slides in the forward direction as documents are picked from the stack 18 and the resilience characteristics of the return springs are designed so that the pressure exerted by the pressure plate 20 will remain relatively constant as it slides forward by a predetermined distance. However, the pressure exerted by the pressure plate 20 decreases gradually as the number of documents contained in the stack 18 decreases and hence, the processor unit 72 also takes into account the number of documents contained in the stack 18 and the resilience characteristics of the return springs, in determining the number of pulses to be applied to the stepper motor 50 so that an optimum pressure is exerted on the stack 18 by the belt 30.

As will be also described in more detail later, the function of the retard roller 52 is to separate superposed documents, in the event that two or more documents have been picked from the stack 18 and fed into the nip formed between the retard roller 52 and the belt 30. The position of belt 30 in the picking position will depend on the number of pulses applied to the stepper motor 50 in order that an optimum pressure is exerted by the belt on the stack 18. Therefore, the position of the retard roller 52 must be adjusted in accordance with the position of the belt 30, so that successful separation of superposed documents will be achieved within the nip formed between the belt 30 and the retard roller 52.

In addition, the stored width of the gap between the guide plate 62 and the belt 30 corresponds to the optimum width of the gap required to accommodate documents having a thickness equal to those contained in the cassette 16. For example, documents comprising multiple sheets, such as books of stamps, travelers cheques or coupons are thicker than documents such as single currency notes, and hence a wider gap will be required to accommodate such documents. Otherwise, documents may become jammed in the apparatus causing it to be taken out of service. Similarly, if the gap between the guide plate 62 and the belt 30 is too wide, documents comprising single sheets may become disengaged from the belt 30 and bunch up within the gap to also causing jamming.

The operation of the document feeding apparatus for picking documents will now be described with continuing reference to FIGS. 1 to 3 and FIG. 5. When no pick operation request has been received by the processor unit 72, the pick mechanism 10 is held in an idle condition (as shown in FIG. 3). In this idle condition, the friction belt 30 and pick pulley 28 are in a position separated from the stack of documents 18 and the retard roller 52 assembly is in a retracted position.

When a first pick operation request for documents from a replenished cassette 16 is received by the processor unit 72, the optimum pick mechanism settings are retrieved from the memory unit 74. The processor unit 72 commands the control circuit 76 to drive the stepper motor 50 with a number of pulses equal to the preset optimum number retrieved from the memory unit 74. On receipt of the first pulse by the stepper motor 50, the gearing mechanism 48 is driven, causing the end gear wheel 46 mounted on the drive shaft 32 to rotate in a clockwise direction by a predetermined angular distance (with reference to FIGS. 2 and 3). Rotation of the end gear wheel 46 causes the arm 44 to pivot in a clockwise direction (with reference to FIGS. 2 and 3) which in turn causes the shaft 40 to slide a short distance along the elongated arcuate slots 42 provided in the side plates 12 and 14, so that the pick pulley 28 moves towards the stack of documents 18. This process is repeated as the stepper motor 50 is driven by each successive pulse, the pick pulley 28 moving in steps toward the stack of documents 18 and eventually a portion of the belt 30 engaging the first document 70 of the stack 18. Further movement of the pick pulley 38 brought about by each successive pulse applied to the stepper motor 50 causes the stack 18 to be pushed rearwardly against the spring action of the pusher plate 20. After the stepper motor 50 has been driven by the final pulse, the optimum pressure for picking documents of the type in the cassette 16 is being exerted on the first document 70 of the stack 18 by the portion of the belt 30 in engagement therewith. The stepper motor 50 is de-energized by the control circuit 76 and in the known manner, the stepper motor 50 is locked in position, so that the gearing mechanism 48 and the shaft 40 on which the pick pulley 28 is mounted are maintained in this position.

The control circuit 76 then activates the first and second linear variable displacement transducers 60 and 67 and the first linear actuator 58. The linear actuator 58 causes the retard roller 52 to begin to move from the idle position (shown in FIG. 3) towards the belt 30 which is now positioned so as to exert an optimum pressure on the stack of documents 18. As the retard roller 52 moves, the first linear variable displacement transducer 60 continuously transmits output signals representative of the position of the retard roller 52 in relation to the belt 30, to the processor unit 72. These signals are compared with the optimum position for the retard roller 52 which was retrieved from the memory unit 74 and, when the measured position is determined to be equal to the optimum position, the linear actuator 58 is deactivated by the control circuit 76. The position of the retard roller 52 in relation to the belt 30 has now been adjusted so that successful separation of superposed documents will be achieved during a pick operation.

On activation of the second linear variable displacement transducer 67, a signal is transmitted thereby to the processor unit 72 corresponding to the initial width of the gap between the guide plate 62 and the belt 30, which is now positioned so as to exert an optimum pressure on the stack of documents 18. This initial gap width is compared with the optimum gap width retrieved from the memory unit 74 and, on the basis of this comparison, the processor unit 72 determines whether the guide plate 62 should moved toward the belt 30 so as to decrease the width of the gap, or away from the belt 30 so as to increase the gap width. The second linear actuator 66 is then activated by the control circuit 76 and the guide plate 62 is moved in the determined direction. In a similar manner as described above in relation to movement of the retard roller 52 assembly, the second LVDT 67 continuously produces output signals representative of the width of the gap between the guide plate 62 and the belt 30 which are compared with the optimum gap width. When the measured gap width is equal to the optimum gap width, the linear actuator 66 is deactivated by the control circuit 76. Of course, if the initial gap width measured by the linear variable displacement transducer 67 equals the optimum gap width, no adjustment is required and the linear actuator 66 is not activated.

Since the pick mechanism 10 has now been adjusted to the optimum settings for handling of documents of the type contained in the cassette 16, feeding of documents may now begin. The processor unit 72 commands the control circuit 76 to energize the motors 36 and 56 and the sensor 68.

The pick operation request may be for a single document, in which case only one pick cycle is to be carried out, or for multiple documents, in which case successive pick cycles are to be carried out until the desired number of documents have been picked from the cassette 16.

The motor 36 drives the shaft 32 via the gearing mechanism 38 causing the drive pulley 26 and the friction belt 30 to rotate. As the friction belt 30 is driven, the pick pulley 28 is caused to rotate about the axis of the shaft 40. The pusher plate 20 is urged against the rear of the stack 18, biasing it towards the pick pulley 28. Since the optimum pressure for picking the documents in the cassette 16 is being exerted by the belt 30 on the first document 70 of the stack 18, this document 70 is separated from the stack 18 by the rotating belt 30 and is moved into the nip between the belt 30 and the retard roller 52.

The retard roller 52 is rotated to move its perimeter in the opposite direction to, and at a significantly lower speed than, the belt 30 at the nip therebetween. Since the position of the retard roller 52 has been adjusted to an optimum position in relation to that of the belt 30 when an optimum pressure is being exerted thereby on the documents of the stack 18, the retard roller 52 engages the rear surface of the picked document 70 as it is moved by the belt 30 through the nip between the retard roller 52 and the belt 30. The frictional force exerted by the belt 30 on the front side of the document 70 is greater than the frictional force exerted by the retard roller 52 in the opposite direction on the rear side of the document 70. In the event that more than a single document is picked from the stack 18 and passes into the nip, the difference in speed and direction of rotation of the belt 30 and the retard roller 52 which engage opposed surfaces of the superposed documents, causes separation of documents from one another. The first document 70 continues to be moved by the belt 30 towards the feed rollers 64, while the other document or documents are restrained by the retard roller 52 from being fed further.

The picked document 70 then passes into the gap between the belt 30 and the guide plate 62. Since the width of this gap has been adjusted so that it is optimum for handling documents having a thickness equal to that of document 70, the picked document 70 is precisely guided by the guide plate 62 as it is moved along by the rotating belt 30, until its leading edge is gripped between the first pair of feed rollers 64 of the transport mechanism. The sensor 68 (FIG. 5) senses when the leading edge of the picked document 70 is gripped between the first pair of feed rollers 64 and sends a signal to the processor unit 72. The feed rollers 64 of the transport mechanism then carry the document 70 away from the stack 18 to a remote stacking or collection point.

If a pick operation request for a single document is received by the processor unit 72, the pick operation is complete on receipt of a signal from the sensor 68 that the leading edge of the document 78 has been engaged with the feed rollers 64. The motors 36 and 56 and the sensor 68 are de-energized by the control circuit 76 until a subsequent pick operation request is received by the processor unit 72. It should be understood that the dimensions of the pick pulley 28, and the position at which the belt 30 makes contact with the stack of documents 18 when it moves into engagement therewith, are such that the leading edge of the picked document 78 will be engaged by the first pair of feed rollers 64 of the transport mechanism before feeding of the next document in the stack 18 begins.

If a multiple document pick operation request was received by the processor unit 72, multiple pick cycles are required in order to complete the pick operation. In such a case, the motors 36 and 56 and the sensor 68 are maintained in an energized condition by the control circuit 76. When the trailing edge of the first document 78 has been fed to such a position that a portion of the rotating belt 30 engages the second document of the stack 18, this document is then separated from the stack 18 and is moved toward the feed rollers 64 of the transport mechanism in the manner described above. This process is repeated until the desired number of documents have been picked from the stack 18. It should be understood that, as successive documents are picked from the stack 18, the pressure exerted by the belt 30 on the first document of the stack 18 will be maintained at the optimum value, since the biasing action of the pusher plate 20 on the rear of the stack 18 will maintain the stack 18 in contact with the belt 30 and will exert a constant pressure on the rear of the stack 18.

On receipt of a signal from sensor 68 by the processor unit 72 after the last document is picked from the stack 18, the motors 36 and 56 and the sensor 68 are de-energized by the control circuit 76 and the belt 30 is brought to rest.

Simultaneously, the stepper motor 50 is re-energized by the control circuit 76 and is driven in reverse by a number of pulses equal to that retrieved from the memory unit 74 at the beginning of the pick operation. The end gear wheel 46 rotates in an anticlockwise direction (with reference to FIGS. 2 and 3), causing the arm 44 to pivot in an anticlockwise direction (with reference to FIGS. 2 and 3). As the stepper motor 50 is driven by each successive pulse, the shaft 40 of the pick pulley 28 slides outwardly in steps along the elongated arcuate slots 42, so that the belt 30 is no longer in contact with the stack of documents 18. When the pick pulley 28 has reached the idle position (shown in FIG. 3), the stepper motor 50 is de-energized and locked in position causing the pick pulley 28 to be maintained in the idle position.

Simultaneously with retraction of the pick pulley 28 from the stack of documents 18, the first linear actuator 58 is activated by the control circuit 76. The retard roller 52 is moved back to the idle position (shown in FIG. 3) and the first linear actuator 58 is deactivated so that the retard roller 52 is maintained in a retracted position.

On commencement of the next and each subsequent pick operation, the stepper motor 50 and the first linear actuator 58 are re-energized so as to move the belt 30 into engagement with the stack 18 until an optimum pressure is exerted thereon for picking documents of the type contained in cassette 16 and to move the retard roller 52 to an optimum position in relation to that of the belt 30 in the picking position. Similarly, the stepper motor 50 and the first linear actuator 58 are deenergized and moved to the idle position at the end of each pick operation.

It should be appreciated that retraction of the pick pulley 28 and the belt 30 to the idle position at the end of each pick operation is carried out to ensure that an optimum pressure will be exerted on the stack 18 by the belt 30 in a subsequent pick operation. As described earlier, the pressure exerted by the pusher plate 20 on the rear of the stack of documents 18 will gradually decrease as documents are picked from the stack 18. While this gradual decrease in pressure has a negligible effect on the optimum pressure being exerted by the belt 30 on the stack 18 in a typical pick operation in which up to 20 documents are picked from the stack 18, the optimum pressure to be exerted on the stack 18 by the belt 30 should also gradually be reduced as the number of documents remaining in the stack 18 decreases, in order to ensure that successful achieved. Hence on completion of each pick operation, the number of pulses to be applied to the stepper motor 50 on commencement of the next pick operation, is reevaluated by the processor unit 74, taking into account the pressure being exerted by the pressure plate 20 on the rear of the stack 18 when the stack contains the number of documents then remaining in the stack 18. This revised setting together with a corresponding revised setting for the position of the retard roller 52, are stored in the memory unit 74 to be retrieved on commencement of the next pick operation. This ensures that an optimum pressure will be exerted by the belt 30 in all subsequent pick operations, irrespective of the number of documents remaining in the stack 18.

The guide plate 62, however, is maintained in position on completion of each pick operation. On commencement of each subsequent pick operation from the document cassette 16, the linear variable displacement transducer 64 is energized and transmits a signal to the processor unit 72 representative of the width of the gap between the guide plate 58 and the friction belt 30. This signal is compared with the optimum gap width and in the event that there is any discrepancy between the two signals, the linear actuator 62 is energized by the control circuit 76, so as to adjust the width of the gap in the manner described earlier. However, adjustment of the position of the guide plate 62 should not normally be necessary from one pick operation to the next, as the width of the gap should remain equal to the optimum width when the belt 30 is moved back into engagement with the stack 18 of documents in a subsequent pick operation. Hence, adjustment of the guide plate 62 is normally required only on commencement of the first pick operation after a new cassette 16 has been inserted into the document feeding apparatus in a replenishment operation.

As discussed above, the document feeding apparatus of the present invention minimizes the risk of mispicking and jamming of documents and ensures that separation of superposed documents is achieved, since the pick mechanism has been adjusted to operate under the optimum conditions for successful picking of documents having the characteristics of those in the cassette 16. Hence, a wide range of different types of documents can be successfully picked using a document feeding apparatus according to the present invention.

It should be understood that the button memory device 22 and the reader 24 could be replaced by other memory and reader devices. For example, the data relating to the documents in the cassette could be stored in magnetic form such as on a magnetic strip, and could be read by a suitable magnetic head associated with the document feeding device. Alternatively, the data relating to the documents in a cassette 16 could be input manually to the processor unit 72 via a keypad associated with the document feeding apparatus during a replenishment operation thereof by service personnel, rather than being read from a memory device on the cassette 16, or could be communicated directly to the processor unit 72 from a host computer of the document management system at the remote replenishment station.

It should also be understood that a friction roller, in association with a suitable operating mechanism, could be used instead of the friction belt 30 and drive 26 and pick pulley 28 assembly. Moreover in some embodiments of the invention, it may not always be necessary to control the position of the retard roller 52 in relation to the belt 30, if the normal position of retard roller 52 is such that it will not block movement of the pick pulley 28, as it is moved into engagement with and retracted from the stack 18.

Figure 4:
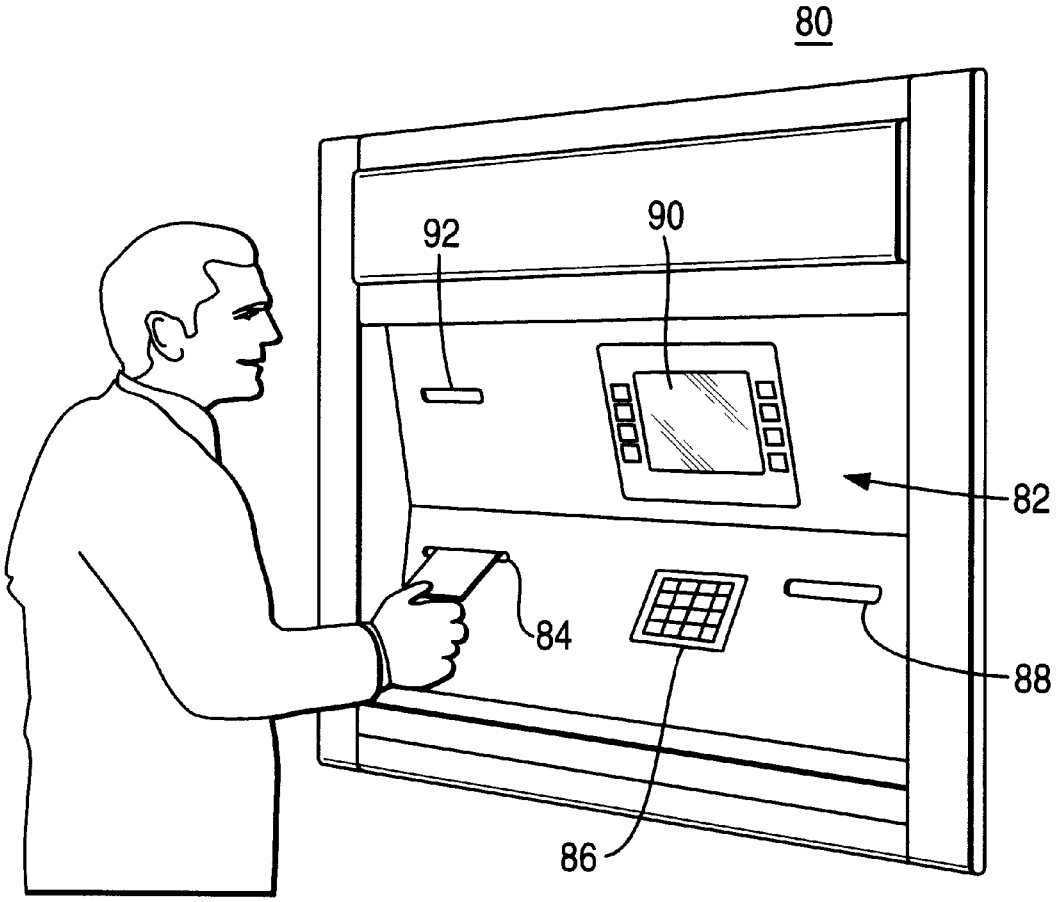
FIG. 4 is a external perspective view of an automated teller machine (ATM) in which the document feeding apparatus of FIGS. 1 to 3 may be used.

Referring now additionally to FIGS. 4 and 5, the document feeding apparatus described with reference to FIGS. 1 to 3 is used in a dispenser module 88 of an automated teller machine (ATM) 80. The ATM 80 is provided with a user interface on its front panel 82 and includes a card reader 84, a key pad 86, a dispenser module 88, a display screen 90, a receipt printer 92 and a control unit 70. The card reader 84, the dispenser 88 and the receipt printer 92 have associated slots located on the front panel 82 of the ATM 80, for insertion of a user's identifying card at the commencement of a transaction and for delivery of currency notes or other documents dispensed by the ATM and a receipt to a user during a transaction, respectively. The dispenser 88 module would normally include more than one document feeding apparatus of FIGS. 1 to 3, each associated with a separate document cassette 16, and stacking and transport mechanisms. Some of the cassettes 16 contain currency notes of various denominations, while others may contain other types of documents such as vouchers, books of stamps, travelers cheques etc. The processor unit 72 controls operation of components of the front panel 82 and various other operating mechanisms of the ATM 80.

In a typical ATM transaction, a user inserts his card into the card reader slot 84 and data encoded on the card is read. Instructions are then displayed on the screen 90. The user is requested to enter a personal identification number (PIN) on the key pad 86 which is verified, usually at a central location remote from the ATM 80. If the PIN is determined to be correct, a menu of the various facilities available to the customer is then displayed on the screen 90. If a cash withdrawal facility is selected, the customer is requested to enter the sum required on the key pad 86. If a voucher purchase, stamp purchase, travelers cheque purchase or other document purchase facility is selected, the customer is requested to enter the number of documents or cash equivalent amount required. These requests are transmitted to the processor unit 72 as a pick operation request for the number of currency notes or other documents to be dispensed to the user from the particular document cassette or cassettes 16 in which they are stored within the dispenser module 88. The document feeding apparatus of the dispenser 88 operates in the manner described above, with the optimum pressure being exerted on the currency notes or other documents being picked from the relevant document cassette or cassettes 16 and an optimum gap width for such documents existing between the guide plate 58 and the belt 30. The pick operation continues until the desired number of documents have been picked from the relevant cassette or cassettes 16 and fed by the feed rollers 60 of the transport mechanism of the dispenser module 88 to a stacking mechanism (not shown). The documents are then delivered to the user through the dispenser slot in the front panel 82 of the ATM 80.

What is claimed is:

1. A document feeding apparatus for picking documents one by one from a stack of documents, the document feeding apparatus comprising:

feed means for moving the document away from the stack;

rotatable pick means for frictionally engaging a document to be fed from the stack and to move the document into engagement with the feed means;

means for storing data relating to the characteristics of the documents in the stack; and pressure control means for controlling pressure exerted by the pick means on a document to be fed during a pick operation, based upon the characteristics of the documents in the stack.

2. A document feeding apparatus according to claim 1, further comprising (i) separation means for preventing simultaneous delivery of two or more documents into engagement with the feed means, and (ii) separation control means for controlling the position of the separation means relative to the pick means during a pick operation.

3. A document feeding apparatus according to claim 1, further comprising (i) guide means disposed adjacent the pick means for guiding a document toward the feed means, and (ii) guide control means for controlling the position of the guide means relative to the pick means during a pick operation, based upon the characteristics of the documents in the stack.

4. A document feeding apparatus according to claim 1, further comprising (i) a document cassette in which the stack of documents are held, (ii) memory means associated with the document cassette and for storing data relating to the characteristics of the documents in the stack, and (iii) reading means for reading data relating to the characteristics of the documents in the stack from the memory means.

5. A document feeding apparatus according to claim 4, wherein the data relating to characteristics of the documents in the stack includes data relating to the material from which the documents are made and data relating to the dimensions of the documents.

6. A document feeding apparatus according to claim 1, wherein the pressure control means includes (i) pivotally mounted support means in permanent supporting engagement with the pick means, and (ii) pivot control means for controlling pivotal movement of the support means.

7. A document feeding apparatus according to claim 6, wherein the pick means includes a belt.

8. A document feeding apparatus according to claim 7, further comprising first pulley means having a fixed axis of rotation and for driving the belt.

9. A document feeding apparatus according to claim 8, wherein the pivotably mounted support means includes second pulley means.

10. A document feeding apparatus according to claim 8, wherein the pivot control means includes drive means and an arm, one end of the arm being secured to a shaft on which the second pulley means is mounted, and the other end of the arm being freely mounted on a shaft of the first pulley means and coupled to the drive means.

11. A document feeding apparatus according to claim 3, wherein the guide means is mounted on a linear actuator.

12. An automated teller machine (ATM) comprising:

a bank note cassette for holding a stack of bank notes;

feed means for moving a bank note away from the stack;

rotatable pick means for frictionally engaging a bank note to be fed from the stack and to move the bank note into engagement with the feed means;

means for storing data relating to the characteristics of the bank notes in the stack; and pressure control means for controlling pressure exerted by the pick means on a bank note to be fed during a pick operation, based upon the characteristics of the bank notes in the stack.

13. An ATM according to claim 12, further comprising (i) separation means for preventing simultaneous delivery of two or more bank notes into engagement with the feed means, and (ii) separation control means for controlling the position of the separation means relative to the pick means during a pick operation.

14. A ATM according to claim 12, further comprising (i) guide means disposed adjacent the pick means for guiding a bank note toward the feed means, and (ii) guide control means for controlling the position of the guide means relative to the pick means during a pick operation, based upon the characteristics of the bank notes in the stack.

15. A document feeding apparatus according to claim 12, further comprising (i) memory means associated with the bank note cassette and for storing data relating to the characteristics of the bank notes in the stack, and (ii) reading means for reading data relating to the characteristics of the bank notes in the stack from the memory means.

16. A document feeding apparatus according to claim 15, wherein the data relating to characteristics of the bank notes in the stack includes data relating to the material from which the bank notes are made and data relating to the dimensions of the bank notes.

17. A document feeding apparatus according to claim 12, wherein the pressure control means includes (i) pivotally mounted support means in permanent supporting engagement with the pick means, and (ii) pivot control means for controlling pivotal movement of the support means.

18. A document feeding apparatus according to claim 17, wherein the pick means includes a belt.

19. A document feeding apparatus according to claim 18, further comprising first pulley means having a fixed axis of rotation and for driving the belt, the pivotably mounted support means including second pulley means, the pivot control means including drive means and an arm, one end of the arm being secured to a shaft on which the second pulley means is mounted, and the other end of the arm being freely mounted on a shaft of the first pulley means and coupled to the drive means.

20. A document feeding apparatus according to claim 14, wherein the guide means is mounted on a linear actuator.

21. An apparatus for picking a document from a stack thereof in a cassette comprising:

means for frictionally removing said document from said cassette;

first means for adjusting frictional pressure exerted by said removing means;

means for identifying said document in said cassette; and means for controlling said first adjusting means in response to said document identification.

22. An apparatus according to claim 21 further comprising:

means for frictionally retarding simultaneous removal from said cassette of multiple documents by said removing means; and second means for adjusting frictional pressure exerted by said retarding means, and operatively joined to said controlling means for control thereof in response to said document identification.

23. An apparatus according to claim 22 further comprising:

means for guiding said document between removing means and said retarding means; and third means for adjusting spacing between said guiding means and said removing means, and operatively joined to said controlling means for control thereof in response to said document identification.

24. An apparatus according to claim 23 wherein:

said removing means comprise a first friction rotor;

said retarding means comprise a second friction rotor spaced from said first rotor; and said guiding means comprise a curved guide disposed between said first and second rotors for guiding said document therebetween.

25. An apparatus according to claim 24 wherein:

said first adjusting means comprise an arm pivotally supporting said first rotor; and a stepper motor operatively joined to said arm for adjusting angular position thereof, and in turn adjusting friction pressure exerted by said first rotor.

26. An apparatus according to claim 24 wherein said second adjusting means comprise a linear actuator joined to said second rotor for adjusting position thereof, and in turn adjusting friction pressure exerted by said second rotor.

27. An apparatus according to claim 24 wherein said third adjusting means comprise a linear actuator joined to said guide for adjusting spacing thereof from said first rotor.

28. An apparatus according to claim 24 wherein said controlling means are configured for coordinating positions of said first rotor, second rotor, and guide in response to said document identification.

29. An apparatus according to claim 24 wherein:

said first adjusting means comprise an arm pivotally supporting said first rotor;

a stepper motor operatively joined to said arm for adjusting angular position thereof, and in turn adjusting friction pressure exerted by said first rotor;

said second adjusting means comprise a linear actuator joined to said second rotor for adjusting position thereof, and in turn adjusting friction pressure exerted by said second rotor; and said third adjusting means comprise a linear actuator joined to said guide for adjusting spacing thereof from said first rotor.

30. An apparatus according to claim 29 in combination with an automated teller machine, and further comprising:

means for interfacing with a user; and means for dispensing said document removed from said cassette by said first rotor in response to a transaction made by said user.

* * * * *

UNITED STATES PATENT AND TRADEMARK OFFICE

CERTIFICATE OF CORRECTION

PATENT NO. : 6,155,556
DATED : December 5, 2000
INVENTOR(S) : Andrew Lynch et al.

It is certified that error appears in the above-identified patent and that said Letters Patent is hereby corrected as shown below:

Column 11,
Line 58, delete "document feeding apparatus" and insert -- ATM --.

Column 12,
Line 64, delete "document feeding apparatus" and insert -- ATM --.

Column 13,
Line 3, delete "document feeding apparatus" and insert -- ATM --.
Line 8, delete "document feeding apparatus" and insert -- ATM --.
Line 10, delete "document feeding apparatus" and insert -- ATM --.
Line 19, delete "document feeding apparatus" and insert -- ATM --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*